United States Patent [19]

Yamada

[11] Patent Number: 5,017,971

[45] Date of Patent: May 21, 1991

[54] EXPOSURE DEVICE FOR COPYING APPARATUS

[75] Inventor: Yasushi Yamada, Hachioji, Japan

[73] Assignee: Konica Corporation, Tokyo, Japan

[21] Appl. No.: 360,212

[22] Filed: Jun. 1, 1989

[30] Foreign Application Priority Data

Jun. 15, 1988 [JP] Japan ..... 63-147587

[51] Int. Cl.[5] ..... G03G 21/00

[52] U.S. Cl. ..... 355/313; 355/233

[58] Field of Search ..... 355/313, 314, 233, 308, 355/228, 229, 230, 231, 232, 234, 235; 271/110, 258, 265, 111

[56] References Cited

U.S. PATENT DOCUMENTS

| | | | |
|---|---|---|---|
| 3,813,163 | 5/1974 | Kobayashi | 271/265 |
| 3,936,041 | 2/1976 | Shiina et al. | 271/110 X |
| 4,132,401 | 1/1979 | Gauronski et al. | 271/265 |
| 4,331,328 | 5/1982 | Fasig | 271/111 X |
| 4,444,382 | 4/1984 | Ishikawa et al. | 271/111 X |
| 4,468,114 | 8/1984 | Pels et al. | 355/313 |
| 4,540,170 | 9/1985 | Masuda et al. | 271/265 |
| 4,561,644 | 12/1985 | Clausing | 271/110 X |
| 4,568,172 | 2/1986 | Acquaviva | 355/324 X |
| 4,635,920 | 1/1987 | Kodama | 271/265 |
| 4,739,983 | 4/1988 | Ide et al. | 271/258 X |
| 4,750,726 | 6/1988 | Looney | 271/110 X |
| 4,763,163 | 8/1988 | Hamano et al. | 355/314 |
| 4,771,317 | 9/1988 | Katoh et al. | 355/313 X |

FOREIGN PATENT DOCUMENTS

| | | | |
|---|---|---|---|
| 0116433 | 5/1987 | Japan | 271/111 |
| 0136442 | 6/1987 | Japan | 271/111 |

*Primary Examiner*—A. T. Grimley
*Assistant Examiner*—Thu A. Dang
*Attorney, Agent, or Firm*—Frishauf, Holtz, Goodman & Woodward

[57] ABSTRACT

An exposure control device for use in a copying apparatus capable of performing two kinds of exposure modes wherein the first mode is a stationary exposure mode in which information on a document is read out by moving an optical scanner while the document is kept stationary, and the second mode is a synchronized exposure mode in which information on a document is read out by moving the document in synchronization with the movement of a photoreceptor while the optical scanner is kept stationary. When the number of sets of copies is a single set, the synchronized exposure mode is automatically selected regardless of the input result of a mode key which manually sets the exposure mode. The apparatus comprises a document feeder and a double feed prevention device operating by means of a sheet sensor for feeding a following sheet only when passage of a preceding sheet is detected.

2 Claims, 4 Drawing Sheets

(ADF MODE)

(RDH MODE)

(ADF / RDH MODE)

EXPOSURE DEVICE FOR COPYING APPARATUS

BACKGROUND OF THE INVENTION

The present invention relates to a copying apparatus wherein it is possible to select a synchronized exposure mode or a stationary exposure mode.

In some copying apparatuses, it is possible to select a synchronized exposure mode or a stationary exposure mode.

Stationary exposure is an exposure method wherein a document is stationary and its image information is read by a moving optical system.

Synchronized exposure, on the other hand, is an exposure method wherein exposure is made by a stationary optical system with a document and a photoreceptor both moving synchronously.

In the case of the stationary exposure copying apparatus therefore, an automatic document feeder (ADF device) is popularly used as a document feeding means.

In the automatic document feeder, the document sheets stacked on a document-stacker are fed, sheet by sheet, onto a platen glass, and a document sheet on the platen glass is ejected, after exposure, onto an ejection tray located outside of the apparatus.

In FIG. 5A, the document feeding device 3 mounted on the platen glass of the main body 2 of the copying apparatus functions as an ADF device and in this case, a copy-handling means 1A, usually called a sorter, is frequently used.

On the sorter 1A, there are provided a plurality of ejection trays 5A–5D on each of which the finished copies are stacked sheet by sheet.

In a copying apparatus using a synchronized exposure, on the other hand, an automatic document feeding device of a recycling type (RDH device or Recirculating Document Handler) is popularly used as a document feeding device 3.

In the RDH device, the documents stacked on the document stacker are fed onto a platen glass of the copying apparatus sheet by sheet, and each of the documents on the platen glass, after exposure, is fed back to the document stacker again so that it may be fed repeatedly.

In this case, the copy-handling means 1B, usually called a finisher, is used.

In the finisher 1B, 40 is an ejection tray having a function similar to the sorter 1A, and on the intermediate tray 43, processing units 45 for various processes such as punching, stapling and others are provided. Processed copies are ejected onto the ejection tray 46.

In a copying apparatus wherein it is possible to select either a synchronized exposure mode or a stationary exposure mode, therefore, when an ADF mode is selected, the sorter 1A is used as a copy-handling means, while, when an RDH mode is selected, finisher 1B is used as a copy-handling means. FIG. 6 shows an example of an apparatus wherein the finisher 1B and the sorter 1A are connected in series to be used selectively.

When a synchronized exposure is made in a copying apparatus capable of performing a synchronized exposure and a stationary exposure selectively, it is common that the processing units 45 are used for various processes such as punching, stapling and others.

When considering the aforesaid processes, therefore, the time required for copying using synchronized exposure is longer than that using stationary exposure when plural sets of copies are made from a document.

In the case when a single set of copies is to be made from a document, on the other hand, the time required for copying using the synchronized exposure mode is shorter than that using the stationary exposure mode, even if the processes mentioned above are taken into consideration.

For example, when a user selects a stationary exposure mode (ADF mode) for only one set of copies, it is preferable that the ADF mode be changed automatically to the synchronized exposure mode (RDH mode) which provides the benefit of shorter copying time.

However, conventional copying apparatus of this kind have not been provided with a function that changes the ADF mode automatically to the RDH mode based on the number of sets of copies to be made.

The aforesaid points are reflected in the present invention and it provides a copying apparatus wherein when the stationary exposure mode is selected it may be changed automatically to the synchronized exposure mode when making only one set of copies, thereby reducing the copying time regardless of the exposure mode selected.

SUMMARY OF THE INVENTION

To solve the aforesaid problems, the copying apparatus of the invention provided with both the synchronized exposure mode and the stationary exposure mode is characterized in that the exposure mode is automatically selected by the conditions established for copying operations.

During the period when the stationary exposure mode is selected, said mode is switched to the synchronized exposure mode when a single set of copies is required.

A user can freely select either the synchronized exposure mode (RDH mode) or the stationary exposure mode (ADF mode).

Even when the stationary exposure mode, (ADF mode), is selected by the user, this mode can be switched automatically to the synchronized exposure mode (RDH mode) when a single set of copies is required.

When plural sets of copies are required under the ADF mode on the other hand, the exposure mode becomes the stationary exposure mode (ADF mode).

Owing to the foregoing, it is possible to make copies in the optimum copying time for both exposure modes.

DETAILED DESCRIPTION OF THE INVENTION

In the present invention, a stationary exposure mode may be applied on both ADF and RDH devices and a synchronized exposure mode also may be applied on both devices. However, for easy explanation, the present description is made on an embodiment in which the stationary exposure mode is used for the ADF device and the synchronized mode is used for the RDH device.

Although the invention covers a copying apparatus wherein either a synchronized exposure mode or a stationary exposure mode can be selected, an explanation of the details of the stationary exposure mode, namely an ADF mode, will be omitted, since they are widely known.

Therefore, the synchronized exposure mode including its document feeding device 3 will be explained, referring to FIGS. 1 and 2.

Figure 1:
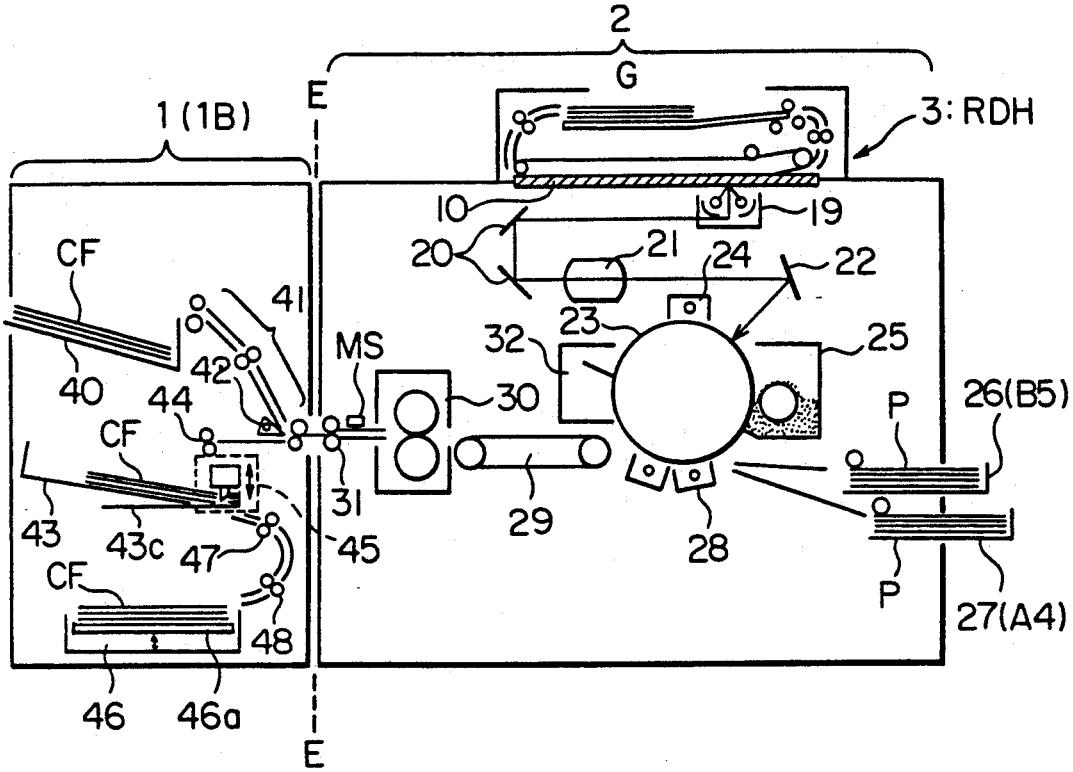
FIG. 1 shows an arrangement of the RDH processing mode, of a copying apparatus of the invention.

The copying apparatus of the invention comprises, as shown in FIG. 1, a copying apparatus main body 2, the document feeding device 3 and the copied sheet processing device 1 (a finisher in this example) provided on the side where copied sheets are delivered.

The document feeding device 3 will hereafter be called an RDH device, since it functions as both the RDH device and the ADF device. The document-separating ability at the document-feeding section in the RDH device 3 is very important. A 'bottom-feeding' method has hitherto been used as a method high in document-separating ability.

'Bottom-feeding' methods include one wherein documents are sucked and separated one after another by means of a suction device and another wherein documents are separated one by one by friction. Compared with the former, the latter has merits such as lower cost, compactness, easy adjustment and maintenance.

Figure 2:
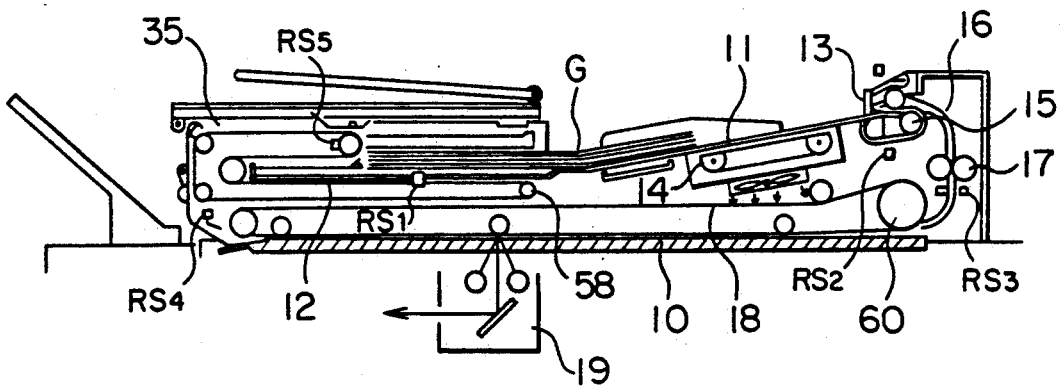
FIG. 2 shows an example of an automatic document feeder of a circulation type.

FIG. 2 shows an example of the latter.

As FIG. 1 shows, the copying apparatus main body 2 is provided thereon with the RDH device 3 and documents fed by the RDH device 3 one after another are copied through a conventional electrophotographic process.

The RDH device 3 is provided on the platen glass 10 mounted on the top of the copying apparatus main body 2, and a plurality of documents G to be copied are stacked, as shown in FIG. 2, on the document-stacker 11 with their image side facing upward in a sequence in which the first page is on the top of the stack of documents. The document sensor RS 1 detects that documents G are placed on the document-stacker 11.

Now, when a start button on the operation panel of the copying apparatus main body 2 is pushed, the trailing edge-positioning plate 12 of the RDH device 3 advances to cause all documents G to move forward (direction toward the right in the figure) and to cause the gate 13 located ahead of the document path to be lifted.

When the leading edge of a document G is detected, after it has advanced to the point that is slightly ahead of gate 13, by the document-leading-edge-detecting sensor RS 2, the trailing edge-positioning plate 12 stops, gate 13 is lowered and the trailing edge-positioning plate 12 returns to its original position.

In this case, the trailing edge-positioning plate 12 is capable of being moved either forward or backward when the conveyance roller 58 is moved to the right or to the left. Therefore, the conveyance roller 58 is provided with a driving means (not shown).

When the document-feeding signals are generated from the copying apparatus main body 2 in a predetermined timing, the substantially semi-circular shaped feed-out roller 14 makes a turn and, concurrently with that, a double-feed-preventive roller 15 rotates to feed a document sheet located at the lowest position in the stack. The document thus fed out advances along the guide plate 16, then is conveyed by the conveyance roller 17 to be detected at its leading edge by the timing sensor RS 3, and is moved onto the platen glass 10 at a predetermined speed by the conveyance belt 18 passing over conveyance roller 60.

Under the platen glass 10, there is provided an optical system 19 comprising of a lamp for irradiating the document, reflection mirrors and so forth, and the document is exposed to light by means of the optical system while it is traveling.

When the document-leading-edge-detecting signals from the timing sensor RS 3 are sent into the copying apparatus main body 2, a transfer sheet starts to be transported in the copying apparatus main body 2. The document, after being exposed to light, is detected by the sheet-exit sensor RS 4 and is transported by another conveyance belt 35 to be placed on the documents remaining on the document-stacker 11.

The final delivery of the document is detected by the circulation type delivery sensor RS 5. Jamming taking place during the conveyance of a document can be recognized by the detection timing relating to both timing sensor RS 3 and placement sensor RS 4.

The second document starts to be fed out when the trailing edge of the first document is detected by the timing sensor RS 3.

When exposure by the optical system of the copying apparatus main body for all documents is completed in the same manner as the foregoing, the document-leading-edge-detecting sensor RS 2 confirms '0' as the number of documents, thus document feeding for one set of documents to be copied is completed. When several sets (e.g. 5 sets) of copies from the same original documents are to be made, the exposure for documents from the last document to the first document is repeated as many times as is necessary, corresponding to the number of sets of copies required.

In synchronization with the aforesaid actions in the RDH device 3, the following electrophotographic processes are carried out in the copying apparatus main body 2.

When the document travelling on the platen glass 10 of the copying apparatus main body 2 at a constant speed is scanned optically by the optical system, the reflected light from the document is projected onto the photoreceptor 23 via the mirror 20, the lens 21 and the mirror 22. Since the surface of the photoreceptor 23 is charged uniformly by the charging device 24, the reflected light from the document, when it is projected onto the surface, causes electrostatic latent images to be formed thereon.

The electrostatic latent images are developed by the developing device 25 to be visible images which are transferred by the transferring device 28 onto the transfer sheet P that is fed, synchronizing with an automatic feeding action for the document, from either the sheet-feeding tray 26 or the sheet-feeding tray 27.

The transfer sheet on which visible images have been transferred is separated from the photoreceptor 23 by means of the separating device, transported by the conveyance belt 29 and is delivered from the apparatus by means of the sheet-exit roller 31 after the images thereon are fixed by the fixing device 30. The numeral 32 is a cleaning device that removes residual toners on the surface of the photoreceptor 23 from which the transfer sheet has been separated.

The copied sheet processing device (the finisher) 1B is equipped with transport roller 41 that delivers copied sheets CF made in the copying apparatus main body 2 and delivered therefrom, without punching or stapling them, onto the paper delivery tray 40 directly.

Further, the finisher is provided with transport rollers 44 which selectively transport the copied sheets CF coming through the raised path-switching gate 42 to an intermediate tray 43, called a stacker, for the purpose of punching and stapling copied sheets CF, to the processing unit 45 that punches or staples one set of the copied sheets CF stacked on the stacker 43 and to conveyance rollers 47 and 48 which convey the punched or stapled copied sheets CF to the final receiving tray 46.

The finisher 1B is so constructed as to be detachable from the copying apparatus main body 2 along line E.

The processing unit 45 comprises of a punch and two staplers arranged on both sides of the punch.

The processing unit 45 is so constructed that it may be removed from the front side of the apparatus, for the purposes of emptying the punch of punched paper scrap produced after punching and of loading or replenishing staples.

In the aforesaid arrangement, MS is a sheet delivery sensor provided on the copying apparatus main body 2, while **46*a* is provided in the tray 46 to be a liftable stage on which the copied sheets CF are stacked. Further, 43*c*** is a stopper used for truing up the leading edges of copied sheets CF.

When the document feeding device 3 is used as an ADF device, it is only necessary to change the synchronized exposure mode to the stationary exposure mode. Therefore, the document feeding device 3 can be used in common.

In the invention, an exposure mode is controlled for the purpose of obtaining an optimum copying time in the copying apparatus used in the aforesaid manner.

Figure 3:
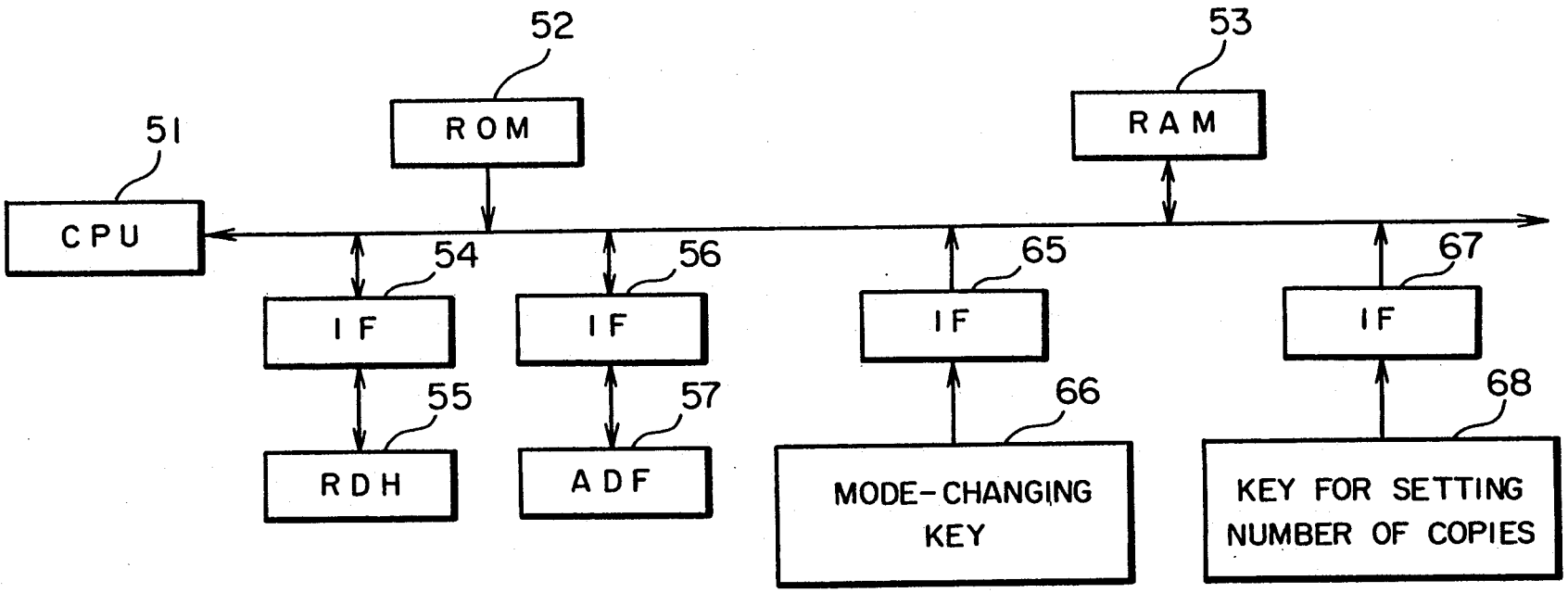
FIG. 3 is a schematic flow diagram showing an example of a selecting system for exposure modes in a copying apparatus.

FIG. 3 is a schematic flow diagram showing an example of an exposure control system, wherein CPU 51 is a CPU controlling copying.

A through-RDH copying system 55 and a through-ADF copying system 57 are connected with each other via interface device 54 and interface device 56 respectively, and they are controlled as desired based on commands from the CPU 51.

The copying apparatus main body 2 is equipped with switching or mode changing key 66 for selecting an ADF mode or an RDH mode, and signals for the switching modes are inputted into CPU 51 through the interface 65, and depending upon the results therefrom, the through-RDH copying system 55 or the through-ADF copying system 57 is selected.

The copying apparatus main body 2 is further equipped with a key 68 for selecting the number of sets of copies required, and the output of key 68 is inputted into the CPU 51 via the interface device 67.

The numeral 52 represents a ROM wherein various kinds of control programs are stored, while 53 represents a RAM for the image memory. RAM 53 is used for processing such as editing.

Figure 4:
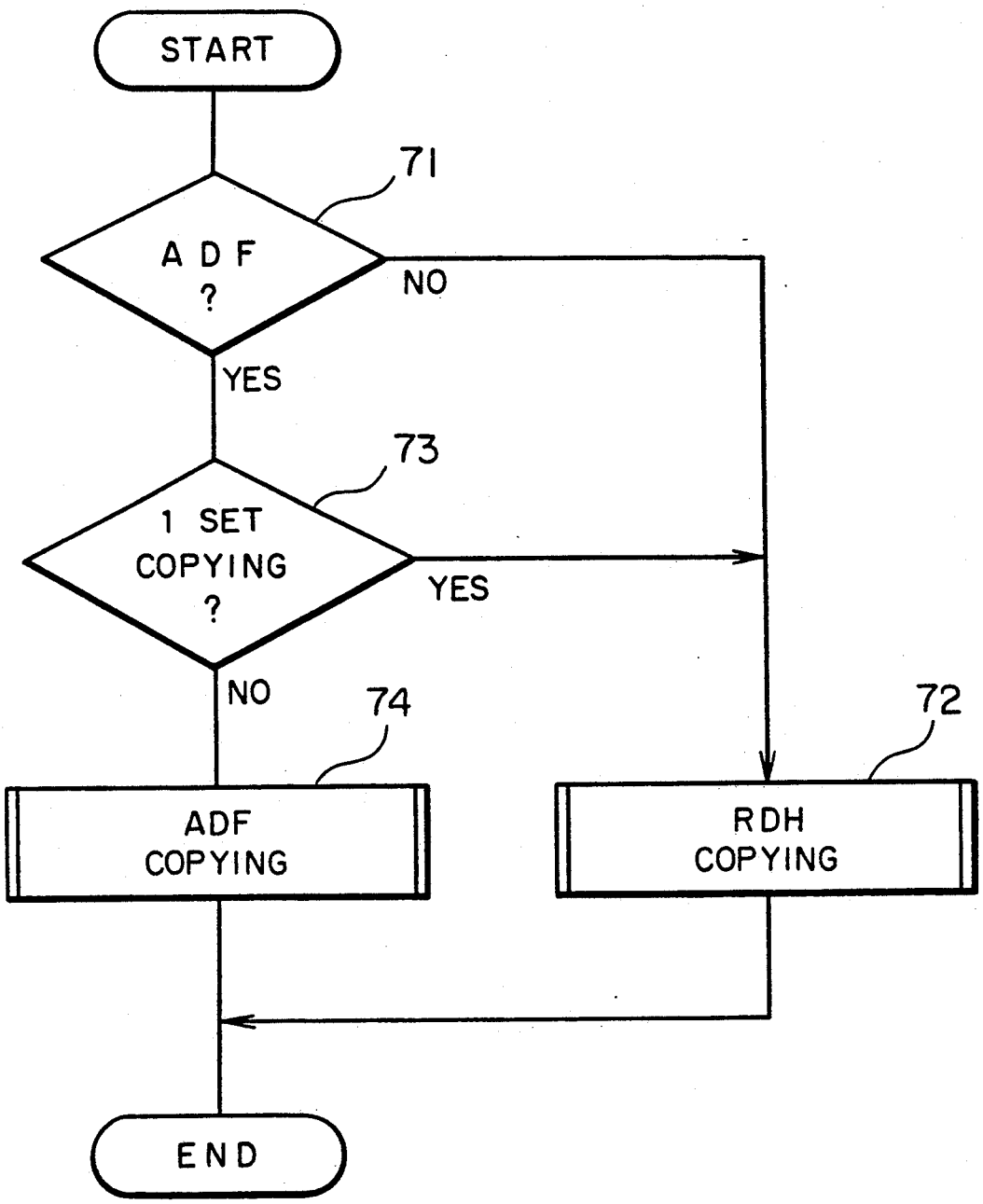
FIG. 4 is a flow chart showing an example of an exposure mode selecting program.
Figure 5A:
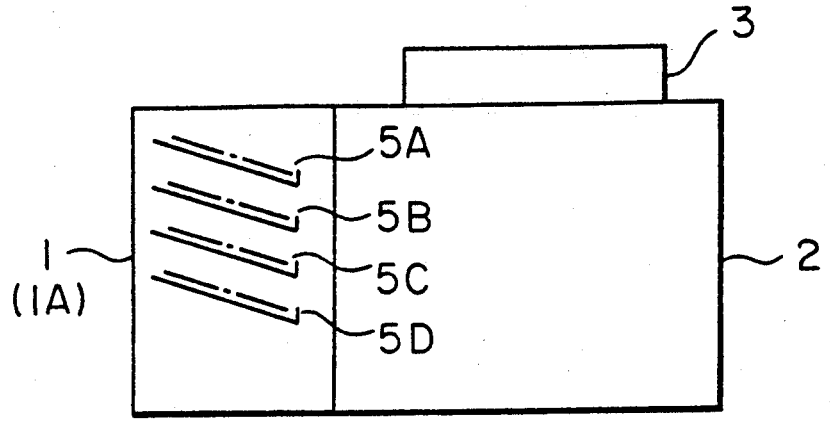
FIGS. 5A and 5B show a copying apparatus wherein either the synchronized exposure mode or the stationary exposure mode can be selected.
Figure 5B:
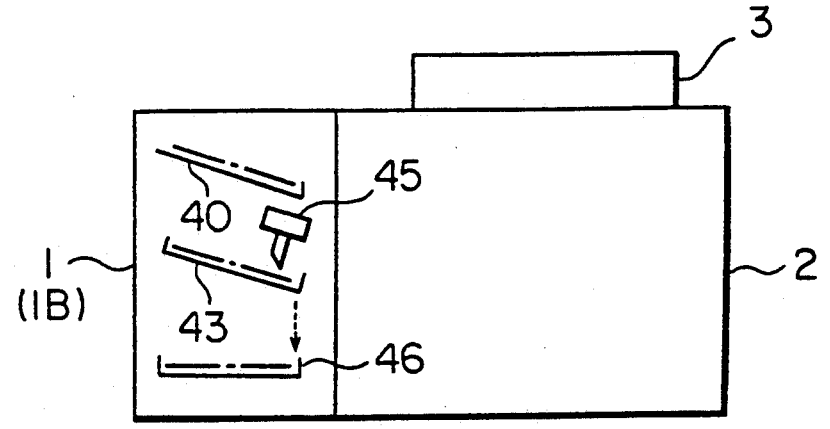
Figure 6:
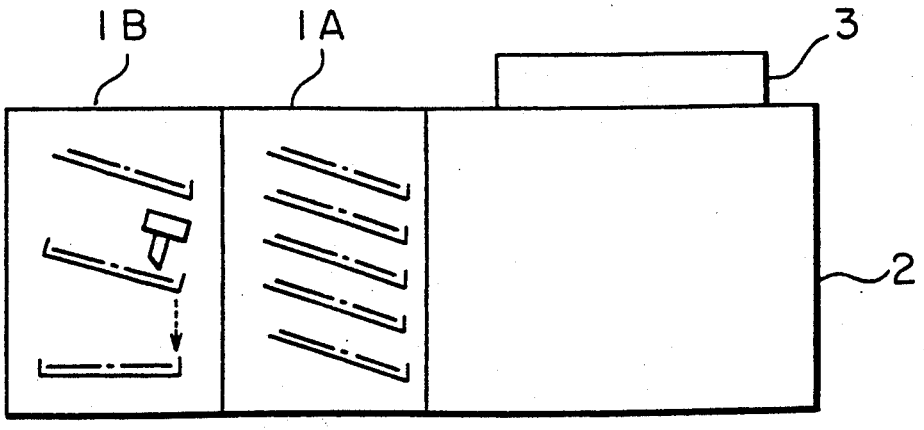
FIG. 6 shows another example wherein the synchronized exposure mode or the stationary exposure mode can be selected.

FIG. 4 is a flow chart showing an example of the exposure mode control program. When the control program of FIG. 4 starts, it checks whether the copy mode is an ADF mode or an RDH mode (step 71). When it is an RDH mode, it shifts to the RDH processing step, and the RDH processing, namely the synchronized exposure processing is carried out (step 72).

When an ADF mode is selected, on the other hand, the number of sets of copies is checked, whether singular or plural (step 73). When plural, the mode becomes an ordinary ADF processing mode (step 74). Subsequently, the stationary exposure processing is carried out.

When the number of copies is one, however, the mode proceeds to an ADH processing mode (step 72) even if an ADF mode is selected. Thereby, when an ADF mode is selected and the number of sets of copies is one, the exposure mode is automatically changed to the synchronized exposure processing mode, which shortens the copying time.

When an ADF mode is selected as an exposure mode, the sorter 1A is used as a document feeding device, while, when an RDH mode is selected, the finisher 1B is used. When an ADF mode is selected in the processing in FIG. 4, therefore, the sorter 1A is in its position for use on the copying apparatus. Under this condition, when the mode is changed automatically to the RDH mode, copies are delivered to the sheet delivery tray 5A on the top.

When the number of sets of copies is plural under the condition of an ADF mode, the selected ADF mode is carried out, resulting in a copying time which is shorter than that in an RDH mode. Likewise, when the number of sets of copies is one under the condition of an ADF mode, the mode is changed automatically to an RDH mode, resulting also in a shorter copying time.

In the invention, as stated above, when the number of sets of copies is one, the exposure mode is changed automatically to the synchronized exposure mode, in the copying apparatus wherein either a synchronized exposure mode or a stationary exposure mode can be selected.

Under this arrangement, it is possible to obtain the optimum copying time either in the synchronized exposure mode or in the stationary exposure mode.

Namely, when the number of sets of copies is plural, the exposure mode becomes the stationary exposure mode which offers a copying time that is shorter than that in the synchronized exposure mode. Further, when the number of sets of copies is one under the stationary exposure mode, the exposure mode is changed to the synchronized exposure mode. Therefore, it is possible to shorten the copying time even for a single set of copies.

What is claimed is:

1. An exposure control device for use in copying apparatus capable of performing two kinds of exposure modes, wherein the first exposure mode is a stationary exposure mode in which information on a document is read out by moving an optical scanner while the document is kept stationary, and the second exposure mode is a synchronized exposure mode in which information on a document is read out by moving the document in synchronization with the movement of a photoreceptor while the optical scanner is kept stationary, comprising:

mode-input means for selecting either the stationary exposure mode or the synchronized exposure mode;

number-input means for setting the number of sets of copies to be copied; and control means for determining a copy exposure mode on the basis of said mode selected by said mode-input means and said number of sets of copies set by said number-input means.

2. The exposure control device of claim 1, wherein the input result of said number-input means is a single set, said control means determines and selects the synchronized exposure mode regardless of the input result of said mode-input means.

* * * * *